US005154984A

United States Patent [19]

Morita et al.

[11] Patent Number: 5,154,984

[45] Date of Patent: Oct. 13, 1992

[54] METAL-CERAMIC COMPOSITE

[75] Inventors: Yoshiyasu Morita; Manabu Seguchi; Kazuo Okamura; Fuminori Hikami; Koichiro Ishihara; Katsutoshi Hara, all of Amagasaki, Japan

[73] Assignee: Sumitomo Metal Industries, Ltd., Osaka, Japan

[21] Appl. No.: 802,719

[22] Filed: Dec. 6, 1991

Related U.S. Application Data

[63] Continuation of Ser. No. 353,192, May 16, 1989, abandoned, which is a continuation of Ser. No. 243,832, Sep. 13, 1988, abandoned, which is a continuation of Ser. No. 917,208, Oct. 9, 1986, abandoned.

[51] Int. Cl.[5] ..... C22C 1/10; C22C 38/00; F27D 5/00

[52] U.S. Cl. ..... 428/614; 266/274; 432/249

[58] Field of Search ..... 428/614, 570; 164/97, 164/108; 89/39.02; 75/235, 242; 266/274, 279; 432/249

[56] References Cited

U.S. PATENT DOCUMENTS

| | | | |
|---|---|---|---|
| 1,423,652 | 7/1922 | Edmondson | 89/36.02 |
| 1,444,610 | 2/1923 | Hutchins et al. | 89/36.02 |
| 3,028,234 | 4/1962 | Alexander et al. | 428/614 |
| 3,723,077 | 3/1973 | Frehn | 75/242 |
| 4,030,891 | 6/1977 | Alexandrov et al. | 75/235 |
| 4,146,080 | 3/1979 | Baum | 164/97 |
| 4,365,997 | 12/1982 | Jachowski et al. | 164/97 |
| 4,473,103 | 9/1984 | Kenney et al. | 164/97 |
| 4,565,744 | 1/1986 | Walter et al. | 428/614 |

FOREIGN PATENT DOCUMENTS

| | | | |
|---|---|---|---|
| 3630429 | 3/1988 | Fed. Rep. of Germany | 89/36.02 |
| 153706 | 9/1983 | Japan . | |
| 60-181222 | 9/1985 | Japan | 266/274 |
| 200948 | 10/1985 | Japan | 428/614 |

OTHER PUBLICATIONS

"2.2 Particle Dispersion Composite Material", Metal 1982.

*Primary Examiner*—John Zimmerman

*Attorney, Agent, or Firm*—Burns, Doane, Swecker & Mathis

[57] ABSTRACT

The present invention relates to a metal-ceramic composite for use in a high temperature and a abrasion-resisting member such as a supporting member of a heating furnace having a construction, in which ceramic particles having superior abrasion resistance and heat resistance are dispersed in a metallic matrix having superior toughness or ceramic blocks are buried in a metallic surface, whereby the characteristics of a ceramic and a metal are simultaneously utilized. A metal-ceramic composite superior in physical characteristic, such as abrasion resistance and heat resistance, and a method of producing the same are provided.

4 Claims, 12 Drawing Sheets

METAL-CERAMIC COMPOSITE

This application is a continuation of application Ser. No. 07/353,192, filed May 16, 1989 now abandoned which is a continuation of application Ser. No. 07/243,832, filed Sep. 13, 1988 now abandoned which is a continuation of application Ser. No. 06/917,208, filed Oct. 9, 1986 now abandoned.

BACKGROUND OF THE INVENTION

1. Field of the Invention

This invention relates to a metal-ceramic composite for use in a heat-resisting member such as a supporting member of a heating furnace, in particular to a metal-ceramic composite, in which a ceramic is added to a matrix formed of a heat-resisting metal or alloy, and a method of producing the same.

2. Description of the Prior Art

In general, various kinds of characteristic, for example oxidation resistance compression resistance, thermal shock resistance, superior weldability, long time stability at high temperatures, mechanical shock resistance and the like, are required for a supporting member such as a skid button of a heating furnace of a slab and the like.

And, heat-resisting alloys, such as heat-resisting alloys of 30Cr-50Co-Fe series and heat-resisting alloys of 27Cr-40Co-20Ni-Fe series, have been used for the supporting member but the use of a single metal is limited in scope of use due to a defect that a creep deformation is apt to occur. On the other hand, the use of ceramics as a substitute for heat-resisting alloys is naturally thought of but the practical use of a single ceramic has a problem due to a low shock-resisting strength of ceramics.

Thus, in order to improve this problem, a composite, in which a metal having a superior toughness is used for a matrix and ceramic particles having a superior abrasion resistance are dispersed in the matrix, is thought of. And, this sort of composite has been developed and some kinds of metal-ceramic composite and method of producing the same have been already proposed. The main metal-ceramic composites and methods of producing the same, which have been recently proposed, are listed as follows:

(1) A method in which a ceramic particle-containing layer is laminated on a backing strip formed of a matrix metal and an assembly is pressed in a semi-melting temperature range of the matrix metal (Japanese Patent Application Laid-Open No. 58-153706).

(2) A method in which ceramic particles are dispersed in a semi-molten matrix metal with stirring, a ceramic particle-dispersed material obtained by molding the dispersion being laminated on a backing strip formed of the same material as the matrix metal, and the assembly being pressed in a semi-melting temperature range of the matrix metal (Japanese Patent Application Laid-Open No. 58-153706).

(3) A method in which ceramic particles are uniformly scattered on a surface of a matrix metal and the assembly is pressed in a semi-melting temperature range of the matrix metal (Japanese Patent Application Laid-Open No. 58-153706).

(4) A molten metal-forging method in which a molten metal (A1) forming a matrix is poured in a mold, which is prepacked with particles to be dispersed, from an upside and pressurized from an upside (Eiichi Nakada: A molten metal-forging as a composite technology, Metal, 1982, p. 19–22).

(5) A method in which composite particles obtained by the occlusion of hydrogen by a ceramic powder-hydrogen occlusion active metal composite are mixed in a molten matrix metal (Japanese Patent Application Laid-Open No. 59-93846).

However, the above described composites and method of producing the same have shown the following problems:

With the arts (1) to (3), particles can be dispersed only in a metallic surface, so that a packing ratio of particles can not be increased, whereby the weight can be only to a small extent. In addition, a compression strength at high temperatures is low and a highly insulating metal-ceramic composite can not be obtained. Besides, a metal-ceramic composite produced by methods according to (1) to (3) is unsuitable for a supporting member of parts complicated in shape since particles are predominantly included in a surface, whereby a shape, in which particles exist on the surface, can not be always obtained after cutting.

Furthermore, with the art (4), the particles are apt to be damaged by a thermal shock in a casting process of a molten metal and gases existing among particles and gases produced in the casting process are difficult to remove since a molten metal for use in a matrix is poured on the particles to be dispersed, so that cavities are formed in a product to deteriorate the quality.

In addition, with the art (5), the particles to be used are limited to ceramics (alumina, zirconia and the like), which strongly bond with active metals such as Ti, Zr, Ta and Nb, and a complicated process of occluding hydrogen by the metal is required.

SUMMARY OF THE INVENTION

The present invention is achieved on the basis of the above described state.

It is a first object of the present invention to provide a metal-ceramic composite, which is superior in characteristic such as compression creep-resisting characteristic, mechanical shock-resisting characteristic, thermal shock-resisting characteristic, oxidation-resisting characteristic, superior weldability and abrasion resistance, at high temperatures, by combining a matrix formed of a heat-resisting metal or alloy with ceramic particles dispersed in the matrix.

It is a second object of the present invention to provide a metal-ceramic composite superior in abrasion resistance and compression resistance by selecting a packing ratio of the ceramic particles of 15 to 85% by volume.

It is a third object of the present invention to provide a metal-ceramic composite superior in abrasion resistance in which the ceramic particles are difficult to separate from the matrix metal by selecting a diameter of the ceramic particles of 1 mm or more.

It is a fourth object of the present invention to provide a metal-ceramic composite, in which a molten matrix metal is easy to put in gaps among the ceramic particles in the producing process by selecting a diameter of the ceramic particles of 1 mm or more.

It is a fifth object of the present invention to provide a metal-ceramic composite, in which the ceramic particles can be easily pushed up by a molten metal in the producing process by selecting a ½ times or less density of the ceramic particles of that of the matrix metal.

It is a sixth object of the present invention to provide a metal-ceramic composite whose weight can be reduced by selecting a ½ times or less density of the ceramic particles of that of the matrix metal.

It is a seventh object of the present invention to provide a metal-ceramic composite improved in heat insulation by selecting a ½ times or less thermal conductivity of the ceramic particles of that of the matrix metal.

It is an eighth object of the present invention to provide a metal-ceramic composite in which the dispersion of the ceramic particles in the matrix metal is improved, whereby improving an adhesion, by coating the ceramic particles with a metal.

It is a ninth object of the present invention to provide a metal-ceramic composite sufficiently endurable to a tensile strength or bending by predominantly making the ceramic particles exist in a part of the metallic matrix since a tensile stress is received by a portion formed of merely metals while a compression stress is received by a portion containing the ceramic particles.

It is a tenth object of the present invention to provide a metal-ceramic composite in which an amount of the ceramic particles to be used can be suppressed to a necessary and minimum extent, whereby reducing the material cost, by making the ceramic particles predominantly exist in a part of the metallic matrix.

It is an eleventh object of the present invention to provide a metal-ceramic composite for which the welding process is easy to carry out, since it is necessary only to weld portions without containing the ceramic particles predominantly exist in a part of the metallic matrix.

It is a twelfth object of the present invention to provide a metal-ceramic composite in which a surface area occupied by the ceramic blocks is increased by burying the ceramic blocks in the metallic surface, whereby the cutting and polishing processes are not required when used.

It is a thirteenth object of the present invention to provide a method of producing a metal-ceramic composite in which gases, such as an air, included among or within the particles and all of gases having the possibility of being produced when a molten metal is brought into contact with the ceramic particles can be discharged into the atmosphere by enclosing the ceramic particles in a chamber provided with an opening at a lower portion thereof and a vent hole on an upper wall thereof and pouring the molten metal into the chamber through said opening.

It is a fourteenth object of the present invention to provide a method of producing a metal-ceramic composite in which there is no possibility that the ceramic particles are broken due to the thermal shock when the ceramic particles are brought into contact with the molten metal by previously heating the ceramic particles contained in the chamber.

It is a fifteenth object of the present invention to provide a method of producing a metal-ceramic composite in which the ceramic particles can be arranged predominantly in a part of a matrix metal by charging the ceramic particles in a chamber with leaving a space in an upper portion of the chamber.

It is a sixteenth object of the present invention to provide a method of producing a metal-ceramic composite in which a surface of a ceramic particle layer of a product can be finished to be flat by placing a drop cover on an accumulation surface of the ceramic particles charged in a chamber.

It is a seventeenth object of the present invention to provide a method of producing a metal-ceramic composite in which a composite having ceramic blocks buried in a surface of a metallic block can be formed by previously supporting the ceramic blocks on an internal peripheral surface of a mold by means of holders, introducing a molten metal into the mold, and solidifying the molten metal.

It is a eighteenth object of the present invention to provide a method of producing a metal-ceramic composite in which a composite having ceramic blocks buried in a surface of a metallic block can be formed by making a heat-resisting sheet, to which ceramic blocks are fixedly adhered, face to the metallic block, pressing the ceramic blocks in the metallic block by hot pressurizing, separating the heat-resisting sheet.

The above and further objects and features of the invention will more fully be apparent from the following detailed description with accompanying drawings.

DETAILED DESCRIPTION OF THE PREFERRED EMBODIMENTS

Figure 1:
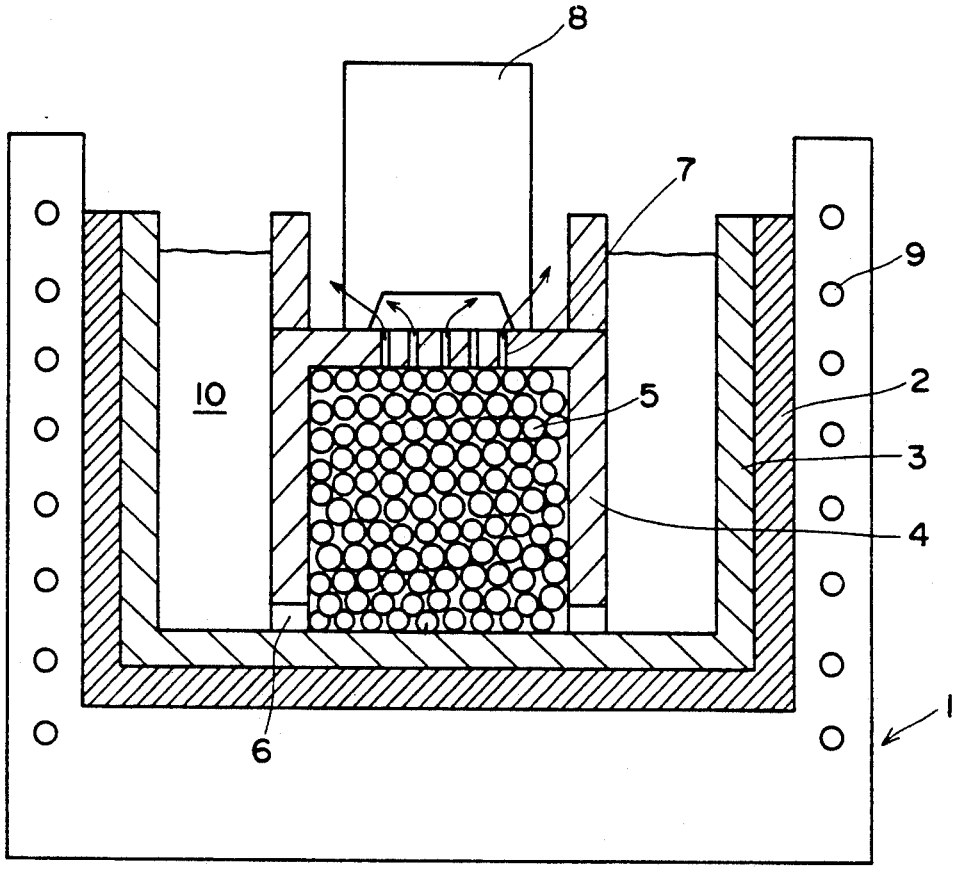
FIG. 1 is a sectional schematic diagram showing an apparatus for producing a metal-ceramic composite according to the present invention.

The preferred embodiments of the present invention are below described with reference to the drawings. FIG. 1 is a sectional schematic diagram showing an apparatus for carrying out a method according to the present invention. An apparatus shown in FIG. 1 mainly comprises a high-frequency furnace 1 for heating a metal and ceramic particles, a vessel 3 provided within the high-frequency furnace 1 through a stamp member 2 for housing a metal 10 for forming a matrix of a metal-ceramic composite therein, and a chamber 4 provided within the vessel 3 for enclosing ceramic particles 5 therein.

The high-frequency furnace 1 is provided with a high-frequency coil 9 as a heating means buried in a furnace wall thereof to melt the solid metal 10 for use in the matrix and previously heat the ceramic particles 5 before the molten metal is introduced.

The chamber 4 is a bottom-opened type. The bottom is closed by the vessel 3. In addition, the chamber 4 is provided with a plurality of openings 6 in a lower portion of a side wall thereof to introduce the molten metal contained in the vessel 3 into the chamber 4. Besides, the chamber 4 is provided with a plurality of hole 7 for venting gases in an upper wall thereof to discharge gases, such as an air, included among and within the ceramic particles and all of gases formed when the molten metal is brought into contact with the ceramic particles into the atmosphere through the holes 7 when the molten metal is introduced into the chamber 4.

In addition, the chamber 4 is provided with a weight 8 placed on an upper wall thereof to prevent ceramic particles having a specific gravity less than that of the molten metal from floating up.

Nextly, a method of producing a ceramic composite by the use of an apparatus as shown in FIG. 1 is described. At first, the ceramic particles 5, for example ceramics of oxide series such as $Al_2O_3$, $3Al_2O_3 \cdot 2SiO_2$, $ZrO_2$ and MgO, ceramics of carbide series such as SiC and TiC, and ceramics of nitride series such as $Si_3N_4$, are enclosed in the chamber 4. Then, the solid metal 10 for forming the matrix of the ceramic composite is housed in the space of the vessel 3. Al and alloys thereof, Ni—, Co— and Cr alloys, steels stainless steels and the like are used as the solid metal 10.

Subsequently, the high-frequency heating is carried out by operating the high-frequency furnace 1 to previously heat the ceramic particles 5 enclosed in the chamber 4 and melt the solid metal 10 housed in the vessel 3. Thus, the metal molten by the high-frequency heating is gradually introduced into gaps among the ceramic particles 5 through the openings 6 provided in the lower portion of the chamber 4 by its own weight or the forced pressurizing of a liquid surface. In this time, also gases generated are gradually pushed up toward the upper portion of the chamber 4 and discharged into the atmosphere through the holes 7 provided in the upper wall of the chamber 4. According to a method of the present invention, the molten metal is poured into the chamber 4 with starting from the lower portion, so that gases can be completely discharged. In addition, since the ceramic particles 5 are previously heated, there is no possibility that the cold ceramic particles are broken when brought into contact with the molten metal. And, upon cooling an inside of the chamber 4, the molten metal is solidified to obtain a metal-ceramic composite in which ceramic particles are uniformly dispersed.

Figure 2:
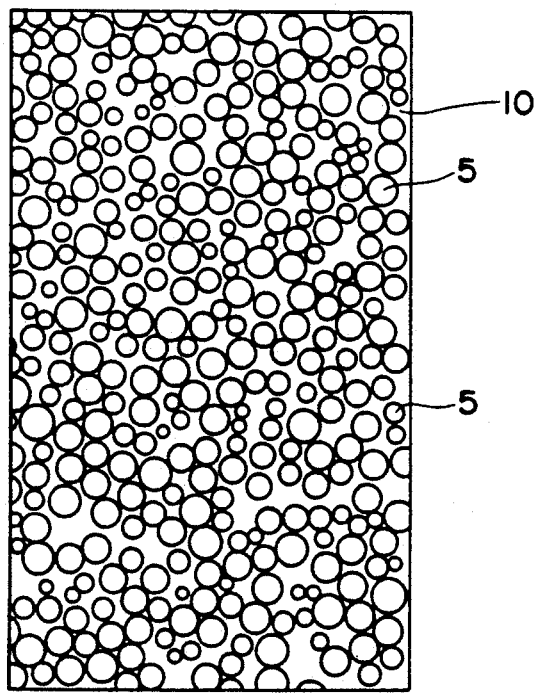
FIG. 2 is a sectional diagram showing a metal-ceramic composite according to the present invention.

FIG. 2 is a sectional diagram showing a metal-ceramic composite obtained by the above described method.

Nextly, a packing coefficient, a diameter, a specific gravity and a thermal conductivity of ceramic particles in a metal-ceramic composite obtained by the above described method are described.

The packing coefficient of ceramic particles of 15 to 85% by volume is suitable. It is the reason of the above described that the packing coefficient of ceramic particles less than 15% leads to a sudden reduction of an abrasion resistance and a compression creep resistance while the packing coefficient of ceramic particles more than 85% leads to a remarkable reduction of a castingability.

The diameter of ceramic particles of 1 mm or more is desirable. If the diameter of ceramic particles is less than 1 mm, the ceramic particles are easy to separate from the matrix metal, whereby suddenly reducing an abrasion resistance. In addition, the molten metal becomes difficult to be introduced into spaces among the ceramic particles. On the contrary, if the diameter of ceramic particles is increased, there is the possibility that the ceramic particles are broken due to a thermal shock in the introduction of the molten metal and a defect occurs in that they are not endurable to a molding process under pressure. Accordingly, the upper limit of a diameter is about 5 mm. However, if the ceramic particles are subjected to a treatment of previously heating in order to prevent the breakage of the ceramic particles due to a thermal shock, the diameter up to about 10 mm is allowable.

Nextly, the specific gravity is described. The specific gravities of typical ceramic particles are shown in Table 1.

TABLE 1

| Item | Name of Particles | | | | |
|---|---|---|---|---|---|
| | $SiO_2$ | $Al_2O_3$ | SiC | $Si_3N_4$ | MgO |
| Specific gravity | 2.5 | 3.9 | 3.1 | 3.1 | 3.5 |
| Content (%) | 93 | 99 | 90 | 97 | 98 |

As obvious from the above Table 1, all specific gravities of the ceramic particles are ½ times that of steels (7.86) or less, for example provided that the packing coefficient is 75%, the weight can be reduced to at least 60% of a single steel.

Nextly, the thermal conductivity is described. The thermal conductivities of said ceramic particles are shown in Table 2.

TABLE 2

| Item | Name of particles | | | | |
|---|---|---|---|---|---|
| | $SiO_2$ | $Al_2O_3$ | SiC | $Si_3N_4$ | Mgo |
| Thermal conductivity (Kcal/mh °C.) | 5.0 | 5.8 | 72 | 2.2 | 10.8 |
| Content (%) | 93 | 99 | 90 | 97 | 98 |

As obvious from Table 2, the thermal conductivity of the ceramic particles is about ⅓ to 1/16 times that of for example steels (36 Kcal/mh°C.) excepting SiC, and generally ½ times that of a matrix metal or less. Provided that the packing coefficient of ceramic particles is 75%, the thermal conductivity of a composite will be about ½ to ⅓ times that of a single steel. That is to say, if the ceramic particles having lower thermal conductivities of the above described ceramic particles are selected as particles to be dispersed when used in the heat shield, a rapid improvement of insulting effect can be expected.

Nextly, the experimental results about various kinds of characteristic of a concrete metal-ceramic composite obtained by the above described method are described.

Figure 3:
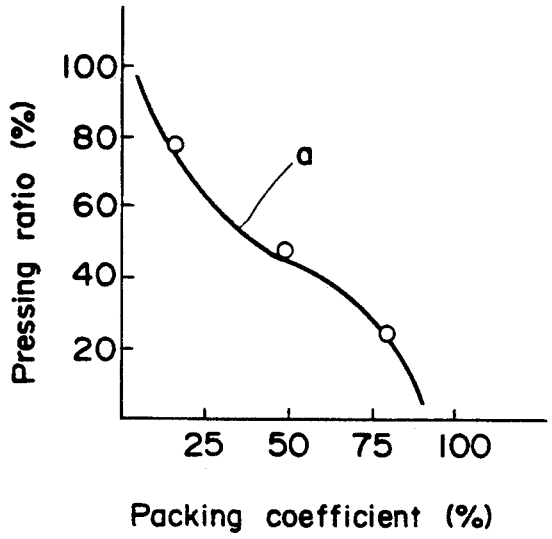
FIG. 3 is a graph showing a relation between a pressing ratio and a packing coefficient of ceramic particles.

At first, as to the moldability under pressure, for example samples containing $Al_2O_3$ having a mean particle diameter of 2 mm in superheat-resisting alloys containing Co at a ratio of 40% at various packing coefficients were tested on the rolling at 1,200° C. and investigated on the critical pressing ratio with the results as shown by a curve a in FIG. 3. The pressing of 25% was possible at the packing coefficient of 70% and the rolled material was superior in quality, that is to say it did not show any breakage with uniformly dispersing the particles in a matrix.

Nextly, metal-ceramic composites having various packing coefficients of ceramic particles were produced for trial from a Co-base heat-resisting alloy as shown in Table 3 as a metallic matrix and alumina particles comprising $SiO_2$ of 7% and $Al_2O_3$ of 91% and having various particle diameters as the ceramic particles and investigated on the abrasion resistance and the pressing ratio, whereby determining the relations between them and the particle diameter as well as the packing coefficient.

TABLE 3

| Name of ingredient | C | Si | Mn | P | S | Cr | Co | Ni | Cu | Mo | V | Fe |
|---|---|---|---|---|---|---|---|---|---|---|---|---|
| Content (%) | 0.13 | 1.06 | 0.94 | 0.004 | 0.003 | 24.40 | 37.96 | 16.16 | <0.01 | 1.23 | <0.001 | Bal |

Figure 4:
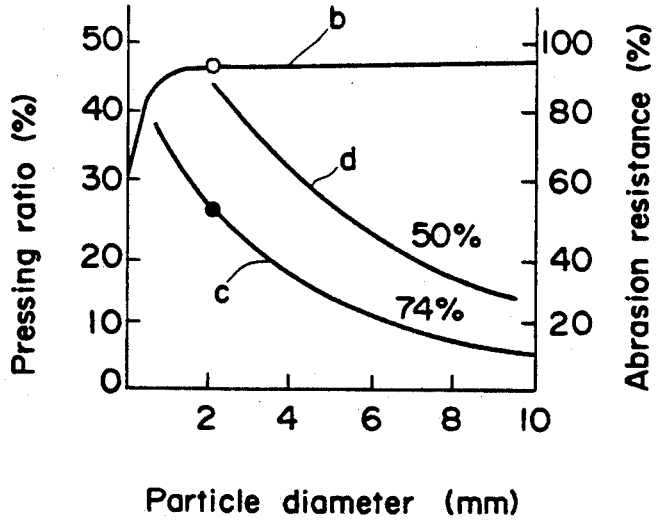
FIG. 4 is a graph showing a relation between a particle diameter of ceramic particles and an abrasion resistance as well as a relation between a particle diameter and a pressing ratio.

At first, as to the relation between the particle diameter and the abrasion resistance, the relation in the case of the packing coefficient of 74% was investigated. In addition, as to the relation between the particle diameter and the pressing ratio, the relations in the cases of the packing coefficients of 74% and 50% were investigated. The results are shown in graphs of FIG. 4. In FIG. 4, a curve b shows a relation between the particle diameter and the abrasion resistance, a curve c showing a relation between the particle diameter and the pressing ratio in the case of the packing coefficient of 74%, and a curve d showing a relation between the particle diameter and the pressing ratio in the case of the packing coefficient of 50%.

Figure 5:
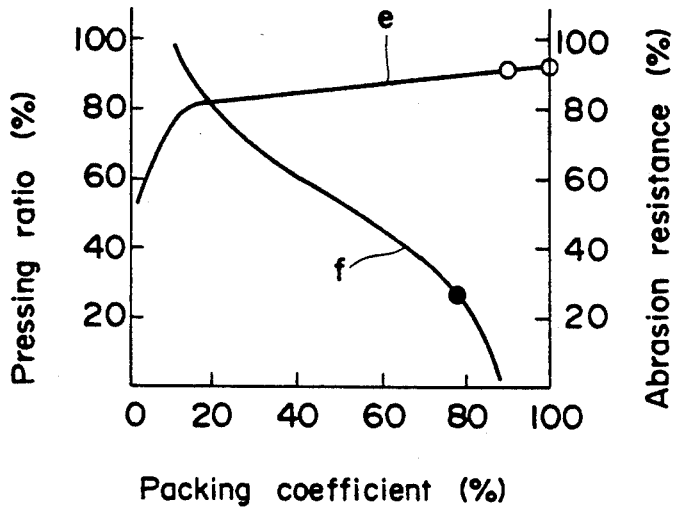
FIG. 5 is a graph showing a relation between a packing coefficient of ceramic particles and an abrasion resistance as well as a relation between a packing coefficient and a pressing ratio.

In addition, as to the relation between the packing coefficient and the abrasion resistance and the relation between the packing coefficient and the pressing ratio, the cases, where said particles having a particle diameter of 2 mm were used, were investigated. The results are shown in FIG. 5. In FIG. 5, a curve e shows a relation between the packing coefficient and the abrasion resistance, a curve f showing a relation between the packing coefficient and the pressing ratio.

Besides, as to the abrasion resistance, a test piece of 10 mm square was cut out from a sample, the test piece being measured on the abrasion weight after sliding as far as 10 km with pressing (at a load of 1 kg) against a specified circular orbit of a disk, which was rotating (at 100 rpm), at room temperature in the pinion-disk manner, and the abrasion resistance being evaluated from a magnitude of a value calculated by the following formula:

$$\Delta W/W \times 100(\%)$$

wherein W is an original weight and ΔW is an abrasion weight. In addition, a test piece having a thickness of 20 mm was cut out from a sample and tested on the rolling by means of a usual hot rolling-mill to determine the critical pressing ratio at 1,200° C.

It is found from FIG. 4 that the particle diameter less than 1 mm leads to a sudden reduction of the abrasion resistance. In addition, it is shown in FIG. 5 that the packing coefficient of ceramic particles less than 15% leads to a sudden reduction of the abrasion resistance while the packing coefficient exceeding 85% leads to a remarkable reduction of the pressing ratio, whereby leading to a remarkable deterioration after rolling.

Metal-ceramic composites comprising a Co-base heat-resisting alloy as shown in said Table 3 and alumina particles (having a diameter of 2 mm) produced in the same manner as the above described metal-ceramic composites were investigated on an amount of creep deformation, hardness characteristics, abrasion characteristics and a weldability. Each test method and the results are described as follows:

(1) Amount of Creep Deformation

A tetragonal prism-like test piece (26.8 mm×42.5 mm×40.6 mm) was cut out from various kinds of metal-ceramic composite produced for trial from the Co-base heat resisting alloy and alumina particles (having a diameter of 2 mm) with various packing coefficients of particles, the test piece being heated at 1,200° C. for one hour under a load (uniaxial pressing) of 2 kgf/mm². the amount of creep deformation was determined by a creep rate (mm/hour).

Figure 6:
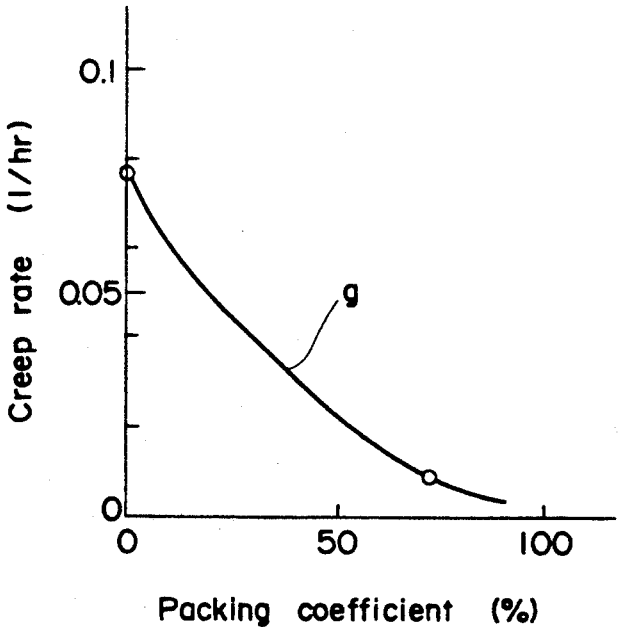
FIG. 6 is a graph showing a relation between a packing coefficient of ceramic particles and an amount of creep deformation.

FIG. 6 is a graph in which a relation between a creep rate and a packing coefficient of ceramic particles is shown by a curve g. As shown in FIG. 6, it is found that an amount of creep deformation of a composite having a packing coefficient of 74% is reduced to about ⅛ times that of a single matrix metal, that is to say the composite having a packing coefficient of 74% has superior characteristics of creep strength.

(2) Hardness Characteristics

Figure 7:
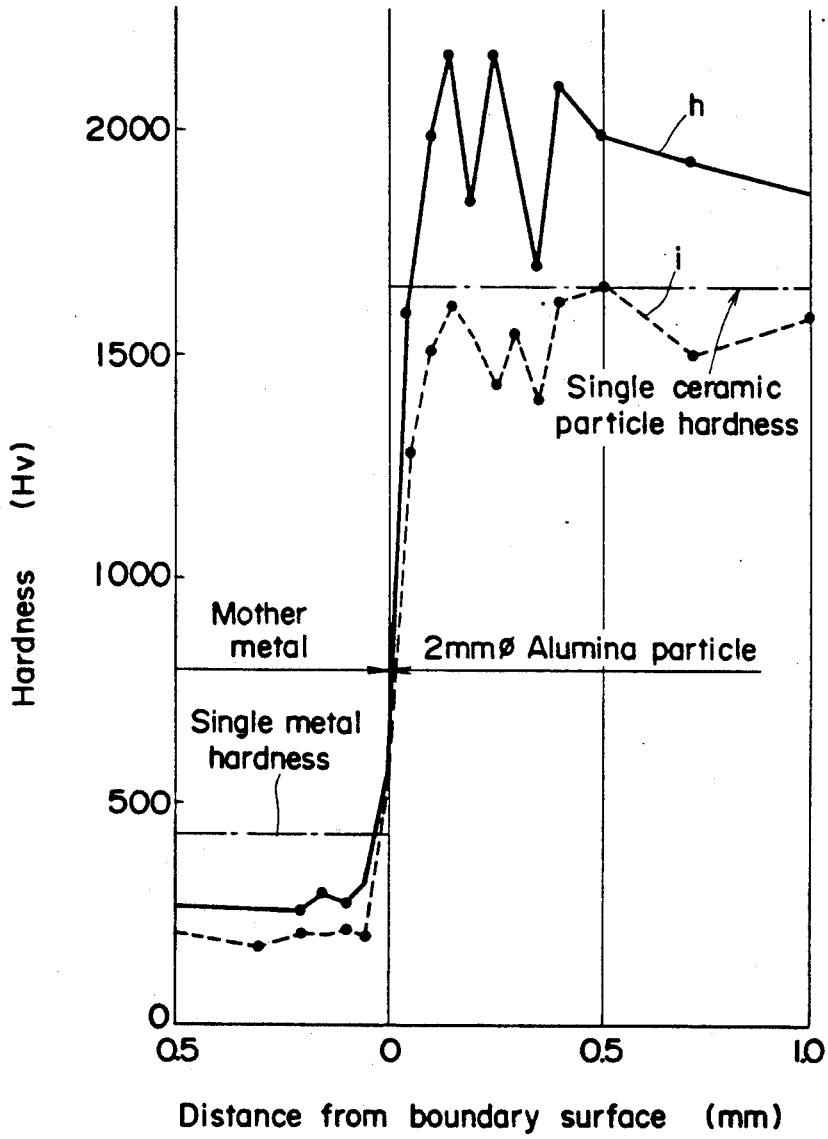
FIG. 7 is a hardness distribution diagram of ceramic particles, boundary surfaces and a matrix metal.

A test piece obtained by casting a metal-ceramic composite comprising a Co-base heat-resisting alloy and alumina particles (a particle diameter of 2 mm, a packing coefficient of 74%) and another test piece obtained by being applied a heat treatment for 24 hours at 1,200° C. after it was cast were determined on a hardness distribution in the ceramic particles, a boundary surface and the matrix metal by means of a micro Vickers hardness tester. The results are shown in FIG. 7. In FIG. 7, a curve h shows the results about the casting metal-ceramic composite (the former test piece) while a curve i shows the results about the metal-ceramic composite (the latter test piece) subjected to the heat treatment after it was cast. It is found from FIG. 6 that the ceramic particles have a 5 to 6 times hardness of that of the matrix metal.

(3) Abrasion Characteristics

Figure 8:
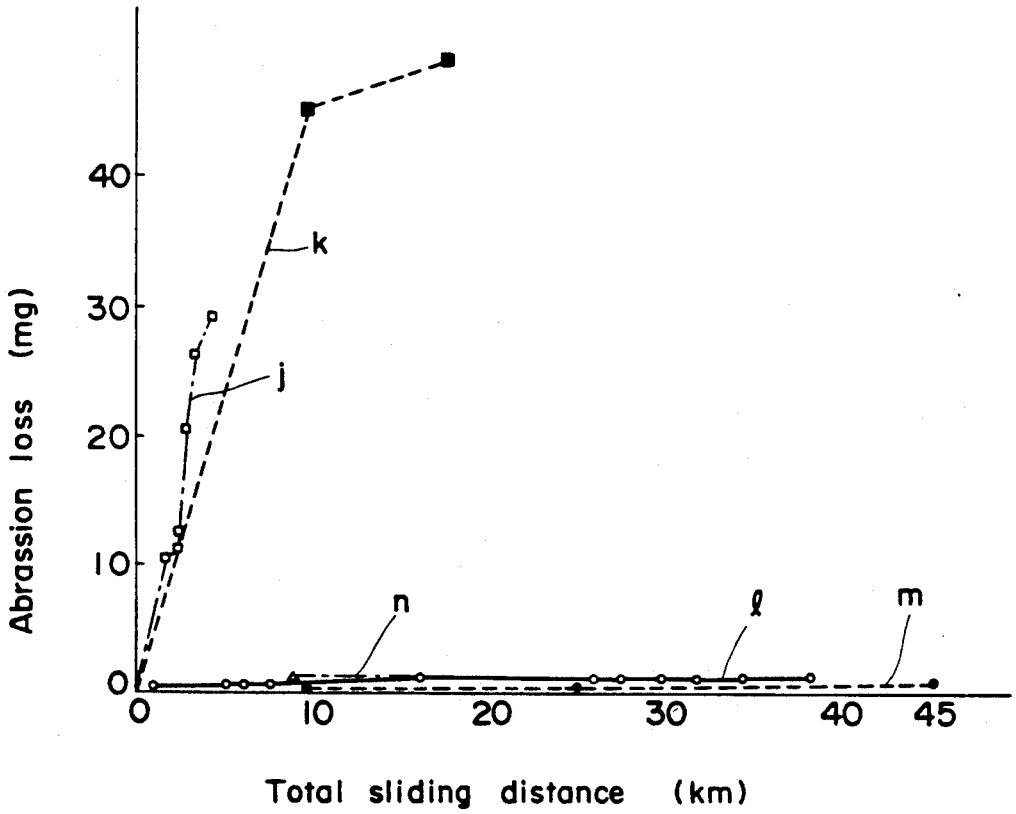
FIG. 8 is a graph showing a relation between a total sliding distance by a pinion-disk method and a loss of abrasion.

A metal-ceramic composite comprising a Co-base heat-resisting alloy and alumina particles (a mean particle diameter of 2 mm, a packing coefficient of 74%) and a metal-ceramic composite comprising S45C steel and similar alumina particles were produced for trial and a test piece of 10 mm square was cut out from them. The test piece was tested on an abrasion resistance in the already described pinion-disk manner with varying a sliding distance. FIG. 8 is a graph showing a relation between a total sliding distance of the test piece (km) and an abrasion loss (mg) in the above described test. In FIG. 8, a curve j shows the results about a single Co-base heat-resisting alloy a curve k showing the results about a single S45C steel, a curve l showing the results about a metal-ceramic composite comprising a Co-base heat-resisting alloy as a matrix, and a curve m showing the results about a metal-ceramic composite comprising a S45C steel as a matrix.

It is found from FIG. 8 that a metal-ceramic composite shows a small abrasion loss akin to an abrasion loss of a single ceramic particle (as shown by a curve n), which is about one over several tens times that of a single matrix metal, that is to say the metal-ceramic composite can be remarkably improved in abrasion characteristic.

(4) Weldability

An adhesion of ceramics to each other can be carried out through silver carbonate, copper oxide, magnesia, nickel or the like but the adhesion is usually broken by a force of 2 to 3 kgf/mm$^2$. Accordingly, the strength can not be expected much. However, if a dispersion density of particles adjacent to a portion to be welded is adjusted so as to be reduced previously in the casting process, the welding substantially results in that of metals among themselves, whereby achieving a superior weldability.

As obvious from the above described explanation, a metal-ceramic composite according to the present invention always exhibits various kinds of stabilized physical property such as abrasion resistance, creep-resisting characteristics, lightness, workability, insulating property and strength. accordingly, a metal-ceramic composite according to the present invention can be very practically used for abrasion-resisting members of various kinds of machine, construction and the like.

Figure 9:
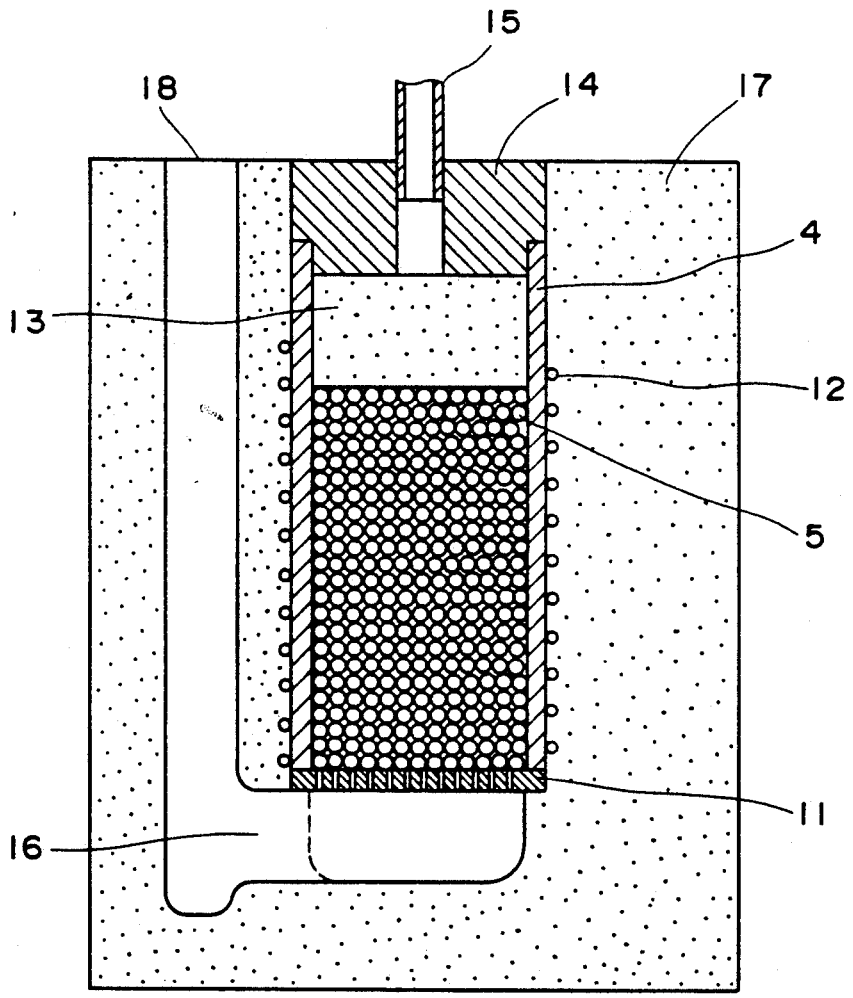
FIG. 9 is a sectional schematic diagram showing an apparatus for carrying out another method of producing a ceramic composite according to the present invention.

FIG. 9 is a sectional schematic diagram showing an apparatus for carrying out another method of producing a metal-ceramic composite according to the present invention. In this preferred embodiment, a bottom wall of a chamber 4 is constructed in the form of a filter 11, an electric heater 12 being wound around an outside periphery of the chamber 4. Ceramic particles 5 coated with Ti, Zr, Ta, Nb or the like are enclosed in the chamber 4, a permeable refractory body 14 being put on the ceramic particles 5, and the permeable refractory body 13 being covered with a sealing refractory body 14. A suction pipe 15 passes through the sealing refractory body 14 to communicate with the permeable refractory body 13 so that gases within the chamber 4 may be sucked by an action of a vacuum pump (not shown) connected to the suction pipe 15. The assembly prepared in the above described manner is put in a sand mold 17 provided with a pouring path 16. At first, the ceramic particles 5 are previously heated by means of the electric heater 12, and then a molten metal is introduced into the chamber 4 through a pouring gate 18, the pouring gate 16 and the filter 11 with sucking gases within the chamber 4 through the suction pipe 15. At last, an inside of the chamber 4 is cooled to solidify the molten metal.

In this preferred embodiment, since an amount of the molten metal poured can be controlled with freedom, a metal exceeding necessity is not poured in the mold, whereby no solidified metal remaining in the pouring path 16. This leads to a higher efficiency. In addition, since gases within the chamber 4 is sucked by means of the vacuum pump, gases within the chamber 4 can be vented more completely in the above described apparatus. Besides, since the ceramic particles 5 are previously coated, the dispersion of the particles in the matrix metal is improved, whereby an adhesion of the particles to the matrix metal is improved.

Figure 10:
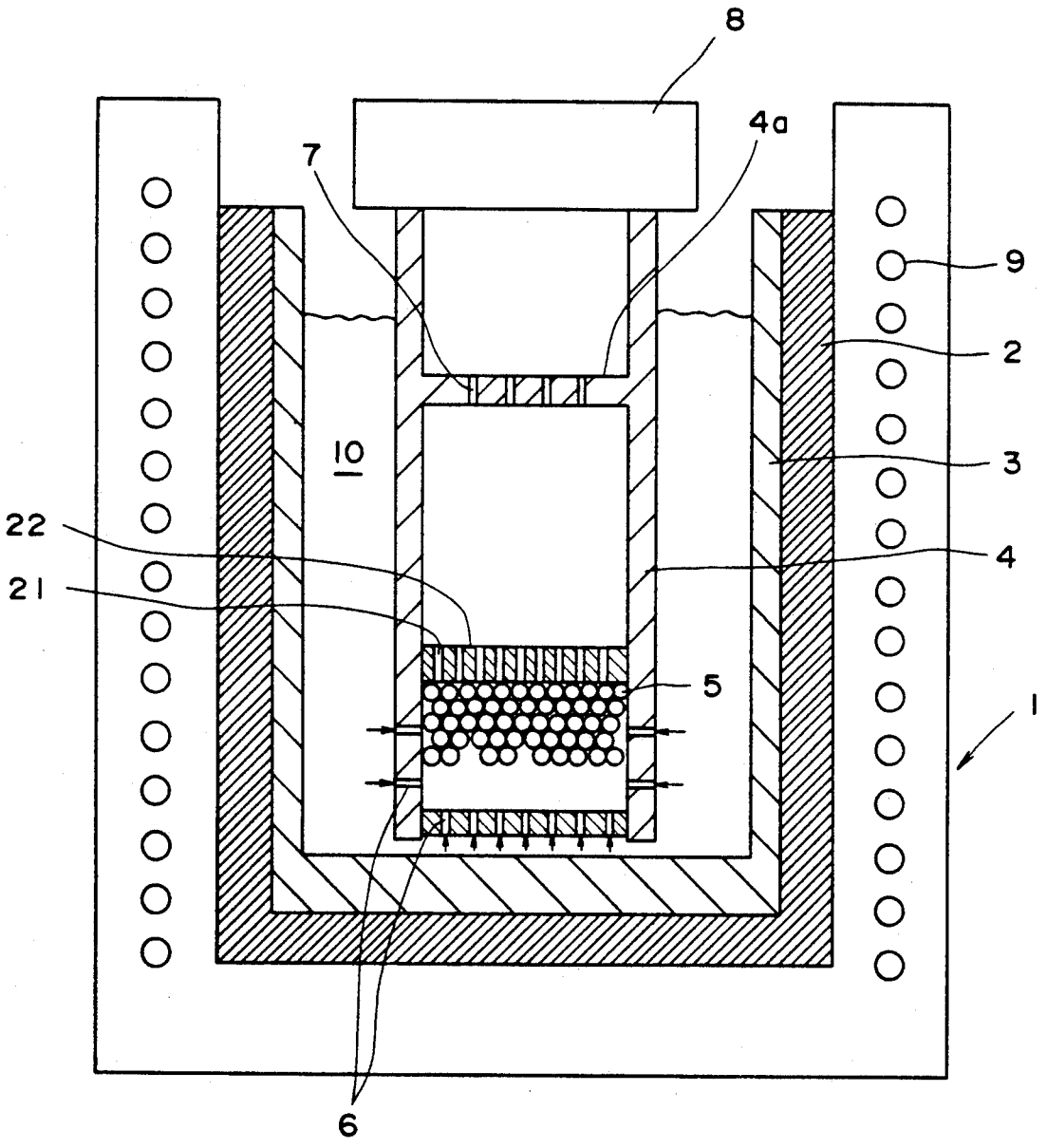
FIGS. 10, 11 are sectional schematic diagrams showing an apparatus for producing a ceramic composite in which ceramic particles are arranged predominantly in a part of a metallic surface.
Figure 11:
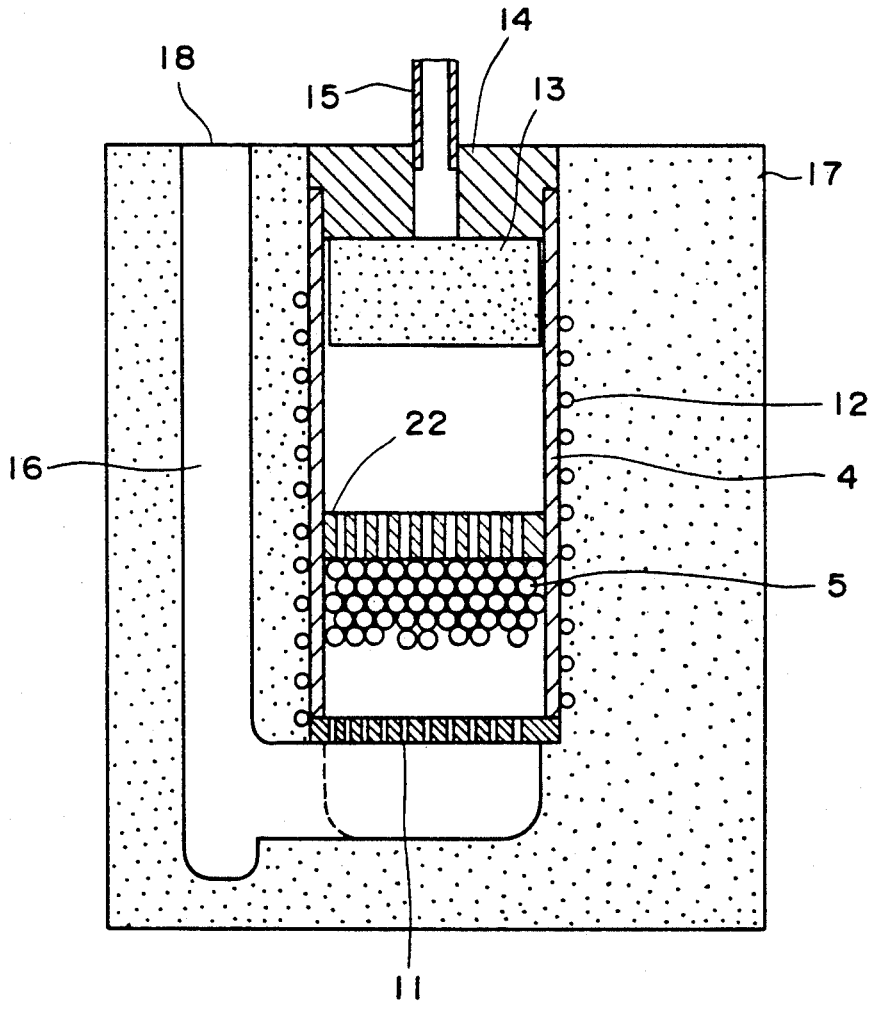

FIGS. 10, 11 are sectional schematic diagrams showing an apparatus for carrying out a method of producing a metal-ceramic composite according to another preferred embodiment of the present invention, in short a metal-ceramic composite in which ceramic particles exist predominantly in a part of a metal as a matrix. At first, FIG. 10 is described.

An apparatus shown in FIG. 10 is similar to the above described apparatus as shown in FIG. 1. In this apparatus, a chamber 4 is provided with a bottom wall, said bottom wall and a lower portion of a side wall being provided with a plurality of openings 6. A desired amount of the ceramic particles 5 is charged in the chamber 4 and a flat disk-like drop cover 22 provided with a plurality of vent holes 21 and having an area slightly smaller than a horizontal sectional area of an internal circumference of the chamber 4 is placed on an accumulation surface of the ceramic particles 5.

Nextly, in operation, a desired amount of the ceramic particles 5 is charged in the chamber 4 with leaving a space in an upper portion of the chamber 4, the accumulation surface of the ceramic particles 5 being made horizontal, and the drop cover 22 being placed on said accumulation surface. On the other hand, a solid metal 10 for forming a matrix is housed in a vessel 3. The ceramic particles 5 within the chamber 4 are previously heated and simultaneously the metal 10 within the vessel 3 is molten by a high-frequency heating by means of a high-frequency coil 9. The molten metal is introduced into the chamber 4 through the openings 6 by its own weight or applying a pressure to a surface of the molten metal if necessary to push up the ceramic particles 5 together with the drop cover 22. The introduction of the molten metal into the chamber 4 is continued until the drop cover 22 is engaged with the upper wall 4*a* of the chamber 4 and the chamber 4 is filled with the molten metal. The ceramic particles 5 will exist predominantly in an upper layer of the molten metal filled in the chamber 4 under the condition that the chamber 4 is filled with the molten metal. If the molten metal is solidified under this condition, a metal-ceramic composite, in which a layer of ceramic particles exists predominantly in one surface side of the metal, can be obtained. In addition, gases existing among and within the ceramic particles and gases produced when the molten metal is brought into contact with the ceramic particles are discharged into the atmosphere through said hole 21 and a plurality of holes 7 formed in the upper wall 4*a*.

Nextly, an apparatus as shown in FIG. 11 is described. An apparatus shown in FIG. 11 is similar to the above described apparatus as shown in FIG. 9. A desired amount of ceramic particles 5 is charged in a chamber 4 and then a drop cover 22 similar in an apparatus as shown in FIG. 10 is placed on an accumulation surface of the ceramic particles 5. The ceramic particles 5 are previously heated by means of an electric heater 12 and then a molten metal is introduced into the chamber 4 through a pouring gate 18, a pouring path 16 and a filter 11 with sucking gases within the chamber 4 through a suction pipe 15. Subsequently, upon cooling an inside of the chamber 4, a metal-ceramic composite, in which a layer of ceramic particles exists predominantly in one surface side of a metal in the same manner as in an apparatus as shown in FIG. 10, can be obtained.

Nextly, the characteristics of a ceramic composite, in which ceramic particles exist predominantly in one surface side of a metal, produced by means of an apparatus as shown in FIG. 10 or FIG. 11 will be described.

(1) Abrasion Resistance

The abrasion resistance is remarkably improved in comparison with a single steel by making ceramic particles having a proper particle diameter (1 to 5 mm) exist predominantly in one surface side of a metal at a proper packing coefficient (15 to 85%). In general, abrasion-resisting members, for example a transport pipe or a stirring drum of slurry fluids, the abrasion-resistance is required only for one surface, for example an inside wall with which the slurries collide, in most cases. If a metal-ceramic composite of this type is used as an elementary material for such members, an effect sufficiently meeting the requirements can be achieved.

(2) Tensile Strength

Since ceramic particles are uniformly dispersed all over the thickness in the above described uniformly dispersed type metal-ceramic composite, a tensile strength of the uniformly dispersed type metal-ceramic composite is slightly lower than that of steel materials. On the contrary, since a layer of ceramic particles exists predominantly in one surface side of a metal and is brought into contact with a portion comprising only a matrix metal (for example steels) in a metal-ceramic composite of this type, the metal-ceramic composite of this type is constructed so as to be ensurable to a tensile force by only this portion comprising only steels and not inferior to also steel materials in tensile strength.

In addition, the metal-ceramic composite of this type exhibits a strength similar to that of materials comprising only steels also against a bending in which a compression stress is applied to a layer of ceramic particles. That is to say, since the metal-ceramic composite of this type receives a tensile stress by a portion comprising only steels and a compression stress by a portion of the layer of ceramic particles, respectively, it is sufficiently endurable also to the bending.

(3) Material Cost

Since ceramic particles exist predominantly in a desired thickness of a surface side of a metal in a metal-ceramic composite of this type, necessary performances is secured by the use of a necessary but minimum quantity of ceramic particles, whereby a quantity of expensive ceramic particles to be used can be reduced and as a result, the material cost can be reduced.

(4) Weldability

Since there is a portion comprising only steels in a metal-ceramic composite of this type, the welding can be carried out by welding this portion, whereby no problem occurs in the welding.

As obvious from the above description, a metal-ceramic composite of this type has a reduced packing coefficient of ceramic particles and a superior abrasion resistance, whereby having been intended to apply to such portions that attach great importance to a tensile strength particularly.

In addition, a thickness of a layer of ceramic particles existing predominantly in a surface side may be properly and optionally set with considering so as to achieve a necessary tensile strength and moldability under pressure.

Figure 12:
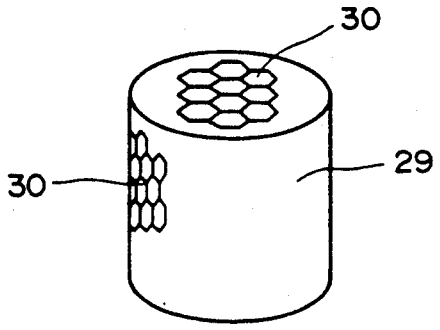
FIG. 12 is a diagram showing a state of burying ceramic blocks in a metallic surface.

Nextly, a metal-ceramic composite according to another preferred embodiment of the present invention, in short a metal-ceramic composite, in which small piece-like ceramic blocks are buried in a superficial layer of a metal in a regularly arranged manner with exposing a surface thereof, is described. FIG. 12 shows a state of burying ceramic blocks 30 in a surface of a metallic block 29 in a regularly arranged manner.

At first, a method of producing a metal-ceramic composite of this type is described.

A method of producing a metal-ceramic composite of this type includes a casting method and a press-in method.

Of them the casting method is a method in which small piece-like ceramic blocks are fixedly supported by holders in a mold so the most of them may be regularly arranged relatively to a desired inside wall of the mold and each surface to be exposed may face to the inside wall of the mold, a molten metal being cast in the mold, and the molten metal being solidified.

In short, it is a method in which a mother metal is cast in a mold under the condition that ceramic blocks are stuck to an inside circumferential surface of the mold to cast the ceramic blocks in a surface of a metallic material.

Figure 13:
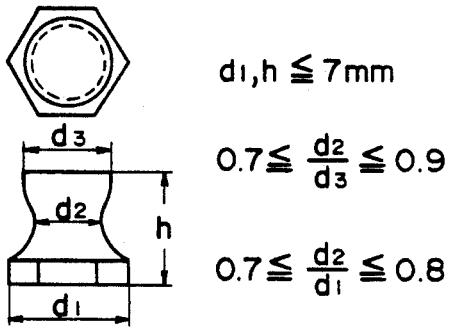
FIGS. 13, 16 and 18 are diagrams showing shapes of ceramic blocks.
Figure 14:
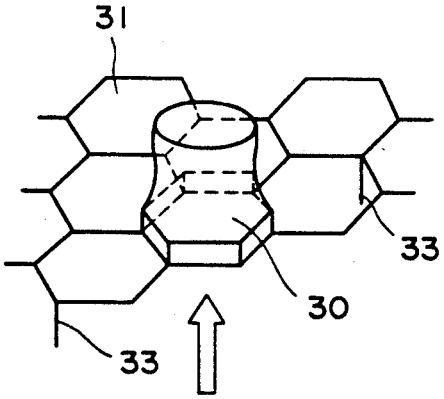
FIGS. 14, 17 and 19 are diagrams showing shapes of nets.
Figure 15:
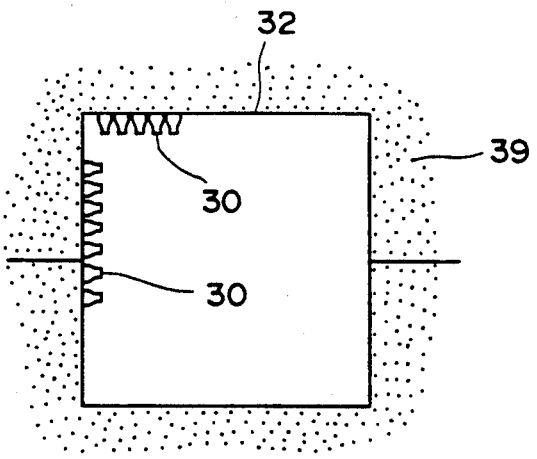
FIG. 15 is a diagram showing a state of arranging and mounting ceramic blocks on an internal wall of a mold.

An example of a shape of the ceramic blocks is shown in FIG. 13. A state of inserting this ceramic block 30 in a net 31 in the direction of an arrow is shown in FIG. 14. As shown in FIG. 15, the ceramic block 30 supported by the net is fixedly supported so that its surface may face to a desired portion of an inside wall 32 of a mold 39 to be cast. The net 31 is fixedly mounted on the mold 39 by burying a foot (33 in FIG. 14) mounted on the net 31 in the inside wall 32 of the mold 39. The net is formed of a material having a melting point nearly equal to that of a molten metal or more since it is necessary only that the metallic net is not molten until a solidified film is formed in a surface of a casting after pouring the molten metal.

Figure 16:
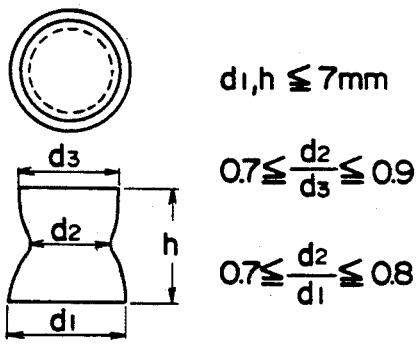
Figure 17:
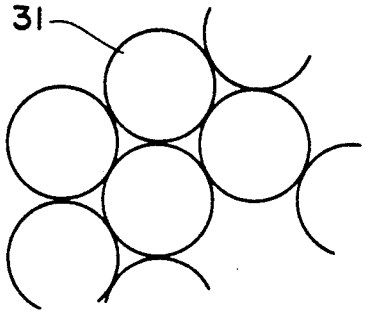
Figure 18:
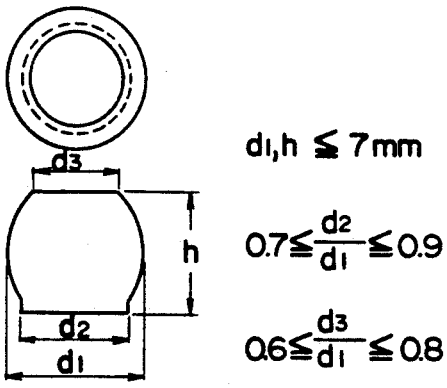
Figure 19:
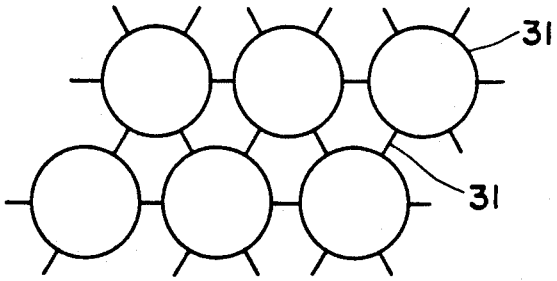

A shape of the ceramic block 30 and the net 31 is not limited to one as shown in FIGS. 13, 14 and the ceramic block having a shape as shown in FIGS. 16, 18 and the net (FIGS. 17, 19) having a shape corresponding to FIGS. 16, 18 may be used.

Nextly, the press-in method is a method in which small piece-like ceramic blocks are fixedly adhered to a rigid heat-resisting sheet with facing their surfaces to be exposed to the sheet in a uniformly arranged manner, the rigid heat-resisting sheet being made face to at least one surface side of a metallic block with directing the ceramic blocks toward the metallic block side, the ceramic blocks being pressed in the metallic block by hot pressurizing, and then said sheet being separated.

Figure 20:
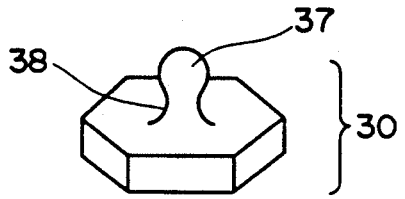
FIG. 20 is a diagram showing a small piece-like heterogonal ceramic blocks.
Figure 21:
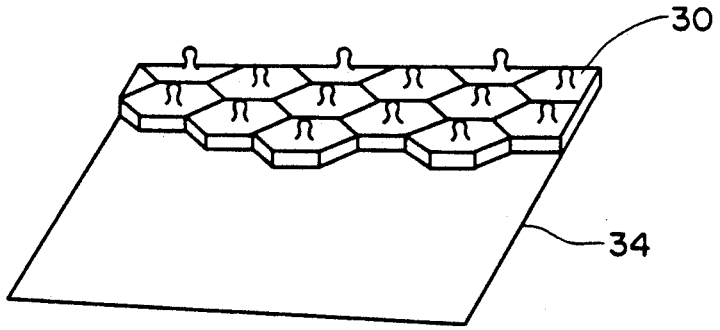
FIG. 21 is a diagram showing an arrangement of ceramic blocks on a heat-resisting sheet.
Figure 22:
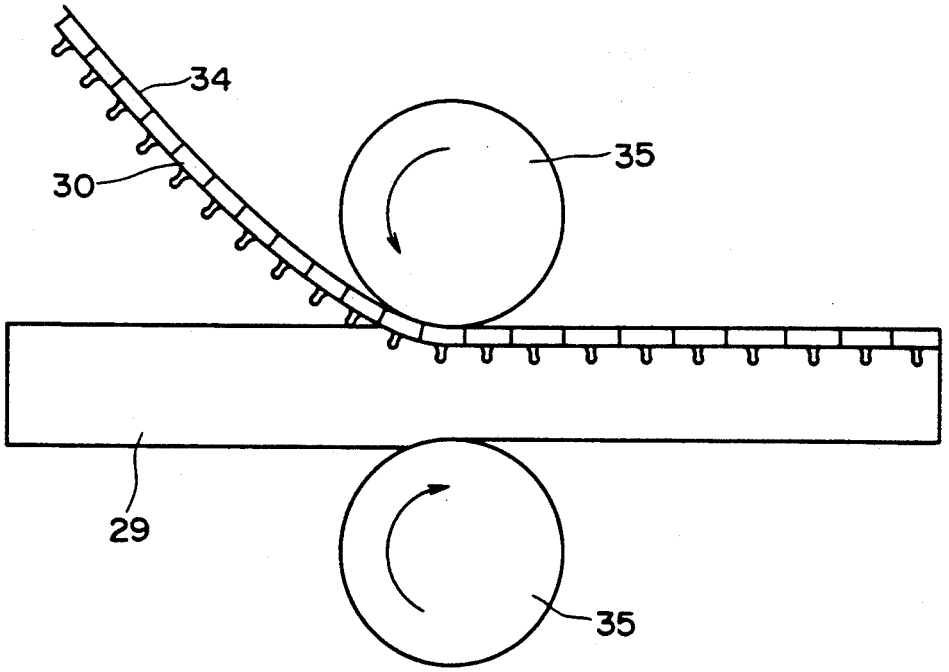
FIG. 22 is a diagram showing a state of pressing a heat-resisting sheet with ceramic blocks arranged thereon in a metallic member.

According to this method, the ceramic blocks are pressed in a surface of the metallic block by lightly rolling in a rolling mill. That is to say, as shown in FIGS. 20 to 22, a heat-resisting sheet 34, to which small piece-like ceramic blocks 30 are fixedly adhered with facing to a surface from which they are intended to be exposed, is laminated on the surface of the metallic block 29 and the laminated assembly is pressed from both sides thereof in a rolling mill 35 to produce a highly abrasion-resisting and heat-resisting metal-ceramic composite. A shape of the small piece-like hexagonal ceramic block is shown in FIG. 20. FIG. 21 shows a state of adhesively arranging the hexagonal ceramic blocks 30 on the heat-resisting sheet 34 and fixedly mounting it with heat-resisting adhesives. FIG. 22 shows a state of pressing the heat-resisting sheet 34, to which the ceramic blocks 30 are fixedly adhered, in the metallic block 29 by means of the rolling mill 35 under heating with supplying the heat-resisting sheet 34 on the metallic block 29.

In the press-in method according to the present invention, the ceramic blocks may be regularly and uniformly arranged on the sheet or arranged in a dispersed manner. The surface of the ceramic block is adapted to have a plane surface or a curved surface coinciding with a surface portion of the metallic block and a club-shaped projection 37 used for pressing the ceramic block in the metallic block is put in the metallic block 29 by rolling, whereby a necking portion 38 is caught in the metallic portion to be fixedly mounted not so as to come out at all. The ceramic blocks may be arranged compactly or roughly. A part of a metallic block may be covered with ceramics. In the casting or pressing-in process, the mother metal is cut into a small sectional area portion of the ceramic block to prevent the ceramic block from coming out and form a strong abrasion-resisting surface. In addition, in the press-in process, the mother metal is brought into contact with the ceramic block when rolled to promote the above described adhesion of the ceramic block to the metallic block.

Figure 23:
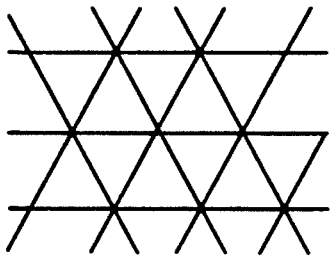
FIGS. 23 to 25 are diagrams showing the arrangement of ceramic blocks when they are regular trigonal, tetragonal and hexagonal.
Figure 24:
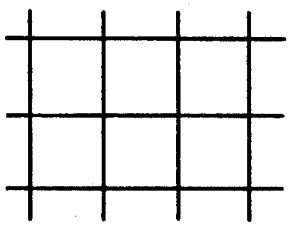
Figure 25:
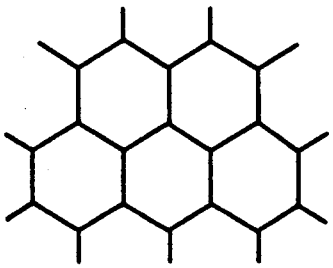

Every shape of the surface portion of the ceramic block capable of occupying a wide range of the metallic surface may be used and the ceramic blocks shall be uniformly arranged on the metallic surface. In the case of the most compact arrangement, a shape of the surface portion of the ceramic block is regular trigonal, tetragonal and hexagonal, as shown in FIGS. 23, 24, 25. Arrangements having uniform intervals, such as a circular arrangement and other polygonal arrangements, can be used in addition to these shapes. In a product according to the present invention, a ratio of a surface area of the ceramic blocks to a surface area of the composite of 100 to 30% is appropriate. Said ratio is 100% for the ceramic block having a regular trigonal, tetragonal, hexagonal surface portion shape.

Since a metal-ceramic composite according to this preferred embodiment has a construction in which at least one surface of the ceramic block is exposed from the metallic surface, the metal-ceramic composite has a larger surface area of ceramics. In addition, an abrasion-resisting surface of the ceramic composite is regulated by casting, rolling or pressing. As a result, in the case where a metal-ceramic composite of this type is used for mechanical parts, the cutting process and the polishing process are not required. Besides, the ceramic particles can be prevented from separating.

Furthermore, the arrangement of the ceramic blocks on the surface of the metallic block can be controlled by supporting or adhering the ceramic blocks in the metallic block by casting or pressing-in. That is to say, the compact arrangement, the rough arrangement and also the coverage of a part of the metallic block with ceramics are possible. In addition, a plate, to which a ceramic block superior in dimensional accuracy is adhered, can be manufactured.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. An abrasion resistant metal-ceramic composite which is formed by casting, and which consists essentially of globular ceramic particles of a material selected from the group consisting of $Al_2O_3$, $3Al_2O_3.2SiO_2$, $ZrO_2$, SiC, $Si_3N_4$, AlN, TiN and silicon aluminum oxynitride (SiAlON) which are coated with a metal selected from the group consisting of Ti, Zr, Ta and Nb and which have a diameter of 1 mm to about 5 mm dispersed in a matrix formed of a heat-resisting metal or alloy based on Ni, Cr, Co and/or steels, said ceramic particles having a density ½ times or less of the density of the matrix metal and a thermal conductivity ½ times or less of that of the matrix metal and a packing ratio of 15–85% by volume.

2. An abrasion resistant metal-ceramic composite as set forth in claim 1, in which said ceramic particles are uniformly dispersed.

3. An abrasion resistant metal-ceramic composite which is formed by casting, and which consists essentially of globular ceramic particles of a material selected from the group consisting of $Al_2O_3$, $3Al_2O_3.2SiO_2$, $ZrO_2$, SiC, $Si_3N_4$, AlN, TiN and silicon aluminum oxynitride (SiAlON) which are coated with a metal selected from the group consisting of Ti, Zr, Ta and Nb and have a diameter of 1 mm to about 5 mm predominantly included in a part of a matrix formed of a heat-resisting metal or alloy based on Ni, Cr, Co and/or steels, said ceramic particles having a density ½ times or less of the density of the matrix metal and a thermal conductivity ½ times or less of that of the matrix metal and a packing ratio of 15–85% of volume.

4. An abrasion resistant supporting member of a heating furnace formed of a metal-ceramic composite which is formed by casting, and which consists essentially of globular ceramic particles of a material selected from the group consisting of $Al_2O_3$, $3Al_2O_3.2SiO_2$, $ZrO_2$, SiC, $Si_3N_4$, AlN, TiN and silicon aluminum oxynitride (SiAlON) which are coated with a metal selected from the group consisting of Ti, Zr, Ta and Nb and which have a diameter of 1 mm to about 5 mm dispersed in a matrix formed of a heat-resisting metal or alloy based on Ni, Cr, Co and/or steels, said ceramic particles having a density ½ times or less of the density of the matrix metal and a thermal conductivity ½ times or less of that of the matrix metal and a packing ratio of 15 to 85% by volume.

* * * * *